US009249576B2

(12) United States Patent
Westgarth

(10) Patent No.: US 9,249,576 B2
(45) Date of Patent: Feb. 2, 2016

(54) RETRACTABLE SUN SHADE

(71) Applicant: Peter Westgarth, Guelph (CA)

(72) Inventor: Peter Westgarth, Guelph (CA)

(73) Assignee: SHADEFX CANOPIES INC., Toronto, Ontario (CA)

( * ) Notice: Subject to any disclaimer, the term of this patent is extended or adjusted under 35 U.S.C. 154(b) by 0 days.

(21) Appl. No.: 13/718,316

(22) Filed: Dec. 18, 2012

(65) Prior Publication Data

US 2013/0180667 A1 Jul. 18, 2013

Related U.S. Application Data

(63) Continuation of application No. 12/666,562, filed as application No. PCT/CA2008/001224 on Jun. 26, 2008, now Pat. No. 8,356,652.

(30) Foreign Application Priority Data

Jun. 26, 2007 (CA) ..... 2592624

(51) Int. Cl.

| | |
|---|---|
| ***E04F 10/04*** | (2006.01) |
| ***E04F 10/06*** | (2006.01) |
| ***E04F 10/02*** | (2006.01) |

(52) U.S. Cl.

CPC ..... *E04F 10/0655* (2013.01); *E04F 10/02* (2013.01); *E04F 10/0607* (2013.01); *E04F 10/04* (2013.01)

(58) Field of Classification Search

USPC ..... 160/46, 84.06, 45, 405, 345; 52/63, 64; 47/17

IPC ..... E04F 10/04,10/02

See application file for complete search history.

(56) References Cited

U.S. PATENT DOCUMENTS

| | | | | |
|---|---|---|---|---|
| 166,618 | A | 8/1875 | Lussenhop | |
| 1,728,074 | A * | 9/1929 | Nicholas | 160/84.06 |
| 1,899,062 | A | 2/1933 | Steffen | |
| 2,193,921 | A * | 3/1940 | Gibbons | 47/17 |
| 2,384,212 | A | 4/1944 | Taylor | |
| 3,315,727 | A * | 4/1967 | Clark | 160/84.06 |
| 3,481,073 | A | 12/1969 | Yoshida et al. | |
| 4,062,146 | A * | 12/1977 | Grossman et al. | 47/17 |
| 4,494,707 | A | 1/1985 | Niibori et al. | |
| 4,557,310 | A * | 12/1985 | Castellaw et al. | 160/84.06 |
| 4,665,964 | A | 5/1987 | Zommers | |
| 4,683,933 | A * | 8/1987 | Dunbar | 160/273.1 |
| 4,694,877 | A | 9/1987 | Dunbar | |
| 4,741,375 | A * | 5/1988 | Milford et al. | 160/84.06 |
| 4,846,249 | A | 7/1989 | Cooper et al. | |
| 5,253,914 | A | 10/1993 | Biancale | |

(Continued)

FOREIGN PATENT DOCUMENTS

| | | |
|---|---|---|
| AU | 635433 B2 | 3/1993 |
| AU | 771317 B2 | 3/2004 |
| GB | 2291901 A | 2/1996 |

*Primary Examiner* — David Purol

(74) *Attorney, Agent, or Firm* — McDonnell Boehnen Hulbert & Berghoff LLP

(57) ABSTRACT

A retractable sun shade, comprising at least one fabric section affixed to a boom, the boom supported and slideably engaged to a track at an intermediate portion of the boom, the track supported by a frame, and at least one flexible drawing element affixed to the boom at the intermediate portion, for drawing the boom in a first direction along the track to extend the sun shade and for drawing the boom in an opposite direction along the track to retract the sun shade.

18 Claims, 18 Drawing Sheets

(56) References Cited

U.S. PATENT DOCUMENTS 5,265,373 A * 11/1993 Vollebregt ..... 47/17
5,794,679 A * 8/1998 Williams et al. ..... 160/46
6,006,809 A * 12/1999 Williams et al. ..... 160/46
6,024,153 A 2/2000 Goldman
6,170,551 B1 * 1/2001 Henningsson et al. .... 160/84.06
2003/0106651 A1 6/2003 Colson

* cited by examiner

RETRACTABLE SUN SHADE

FIELD OF THE INVENTION

This invention relates to sun shades. In particular, this invention relates to a retractable sun shade for a porch, patio, deck or the like.

BACKGROUND OF THE INVENTION

Sun shades are commonly used to shade outdoor living areas such as sun decks. In many climates prolonged exposure to the sun is dangerous, and often the usability of an outdoor living area can be enhanced by shading the area from direct sunlight.

However there are times when a sun shade is not desirable, for example where the warmth or tanning effects of the sun are desired, or at night when a sun shade can block all or part of the night sky.

Retractable awnings are known. Such awnings are conventionally mounted to a vertical structure, such as the wall of a house or commercial premises, and can be extended and retracted by actuation of a gear train which extends and retracts articulating arms that support the awning fabric. The arms typically have a central pivot point, and bend as the awning is retracted to draw the fabric toward the structure; or alternatively unfold as the awning is extended, unfurling the awning fabric and stretching it taut. However, such awnings are typically supported only on one end, and unless the other end is supported by cables or the like from a significantly higher point (which is not always possible), they can practically extend only few meters from the structure before the weight of the extended awning applies too much torque to the mounting point to safely support the awning. Also, when such an awning is extended it can only be retracted by actuation of the gear train, and therefore a high wind catching the awning in the wrong direction can damage the frame or tear the awning away from the structure.

In awnings that are supported on a frame along their depth, the booms are driven at both ends. This leads to frequent jamming, since the ends cannot always be driven at exactly the same rate, especially where a wood supporting frame is used because the shape of the frame and in particular the alignment between joists changes over time.

BRIEF DESCRIPTION OF THE DRAWINGS

In drawings which illustrate by way of example only a preferred embodiment of the invention.

DETAILED DESCRIPTION OF THE INVENTION

Figure 1:
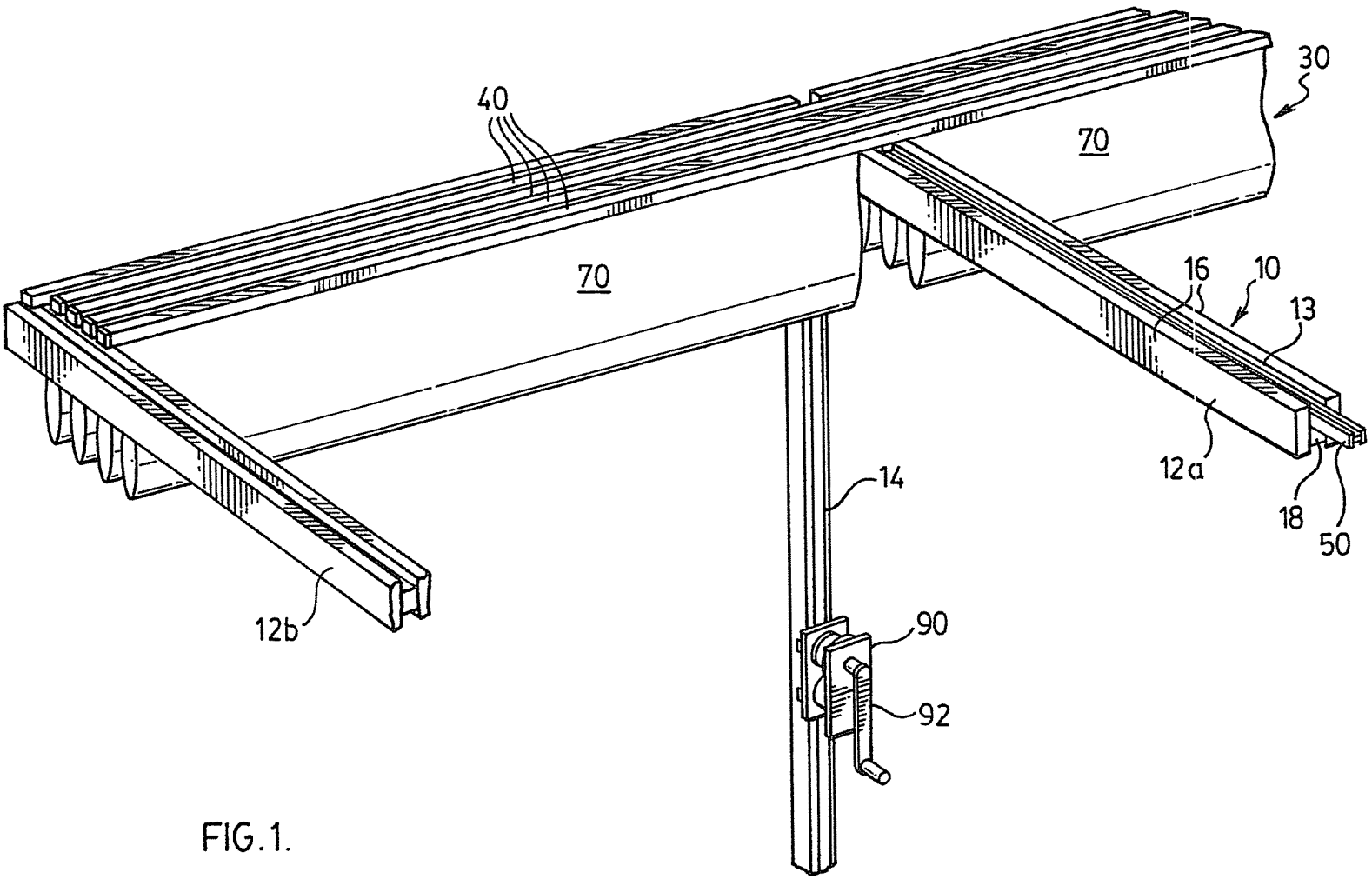
FIG. 1 is a partial perspective view of an embodiment of a retractable sun shade according to the invention in a fully retracted position.

In an embodiment a retractable sun shade is provided. The shade comprising at least one fabric section affixed to a boom, the boom supported and slideably engaged to a track at an intermediate portion of the boom, the track supported by a frame, and at least one flexible drawing element affixed to the boom at the intermediate portion, for drawing the boom in a first direction along the track to extend the sun shade and for drawing the boom in an opposite direction along the track to retract the sun shade.

In an embodiment the frame may comprise a bracket affixed to a structure.

Alternatively, the sun shade may further comprise a plurality of booms supported and slideably engaged to the track at an intermediate portion of each of the booms, each boom connected to a neighbouring boom by at least one fabric section. One of the booms may comprise a drawing boom, the at least one flexible drawing element affixed to the drawing boom, and the remaining booms are drawn along the track as the drawing boom is drawn by the at least one flexible drawing element.

In an embodiment a retractable sun shade is provided. The sun shade may comprise a track supported by a frame; a plurality of runners slideably engaged to the track, a lead runner slideably engaged to the track at an extension end of the runners; a plurality of booms, each of the booms affixed to one of the runners and the lead runner at an intermediate portion of each of the booms; at least one fabric section affixed to, and extending between, adjacent booms; a flexible drawing element affixed to the lead runner, for drawing the lead runner and its affixed lead boom in a first direction along the track to extend the sun shade and for drawing the lead boom in an opposite direction along the track to retract the sun shade. In an embodiment the at least one fabric section drawn by the lead boom may draw the adjacent booms along the track to extend the sun shade.

In an embodiment of the sun shade the booms are disposed above the track. In the embodiment boom supports may be provided for supporting ends of the booms.

In an alternate embodiment of the sun shade the booms are disposed below the track. In the alternate embodiment the booms may be pivotally mounted to the runners. The booms may be affixed such that they are constrained to follow the lead runner along the track, but are free to free to pivot except as constrained by the at least one fabric section.

In an embodiment a method is provided for supporting and actuating a sun shade. In the embodiment the sun shade may consist of at least a lead boom affixed to at least one fabric section, the fabric section further affixed to a retraction point such that there is slack in the fabric when the lead boom is located at the retraction point, the method comprising slideably supporting an intermediate portion of the lead boom between the retraction point and an extension point; and, sliding the lead boom from the retraction point to the extension point by drawing the lead boom from the intermediate portion.

In an alternate embodiment a method is provided for supporting and actuating a sun shade. In the alternate embodiment, the sun shade may consist of a plurality of booms arranged parallel to one another with an intermediate portion of each of the plurality of booms in-line, a lead boom arranged parallel with the plurality of booms, an intermediate portion of the lead boom arranged in-line with the intermediate portion of each of the plurality of booms, the lead boom located between the plurality of booms and an extension point, at least one fabric section affixed to, and extending between, adjacent booms, the fabric section further affixed to a retraction point such that there is slack in the fabric when booms are located at the retraction point, the method comprising slideably supporting an intermediate portion of the booms in-line between the retraction point and the extension point; sliding the lead boom by drawing the lead boom from the intermediate portion of the lead boom; successively sliding the plurality of booms by drawing the at least one fabric section with the lead boom.

Figure 2:
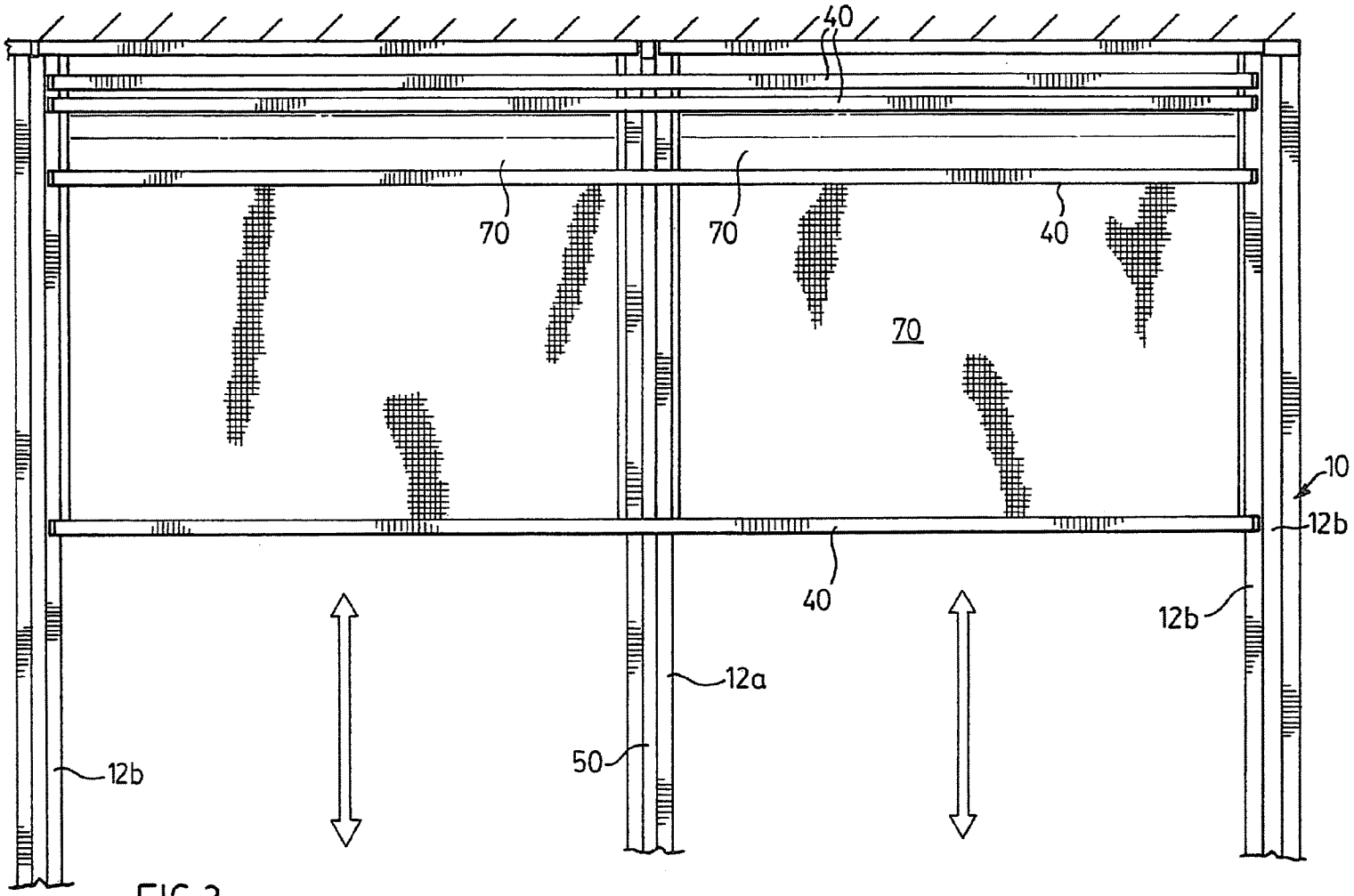
FIG. 2 is a top plan view of the sun shade of FIG. 1 in a partially extended position.
Figure 3:
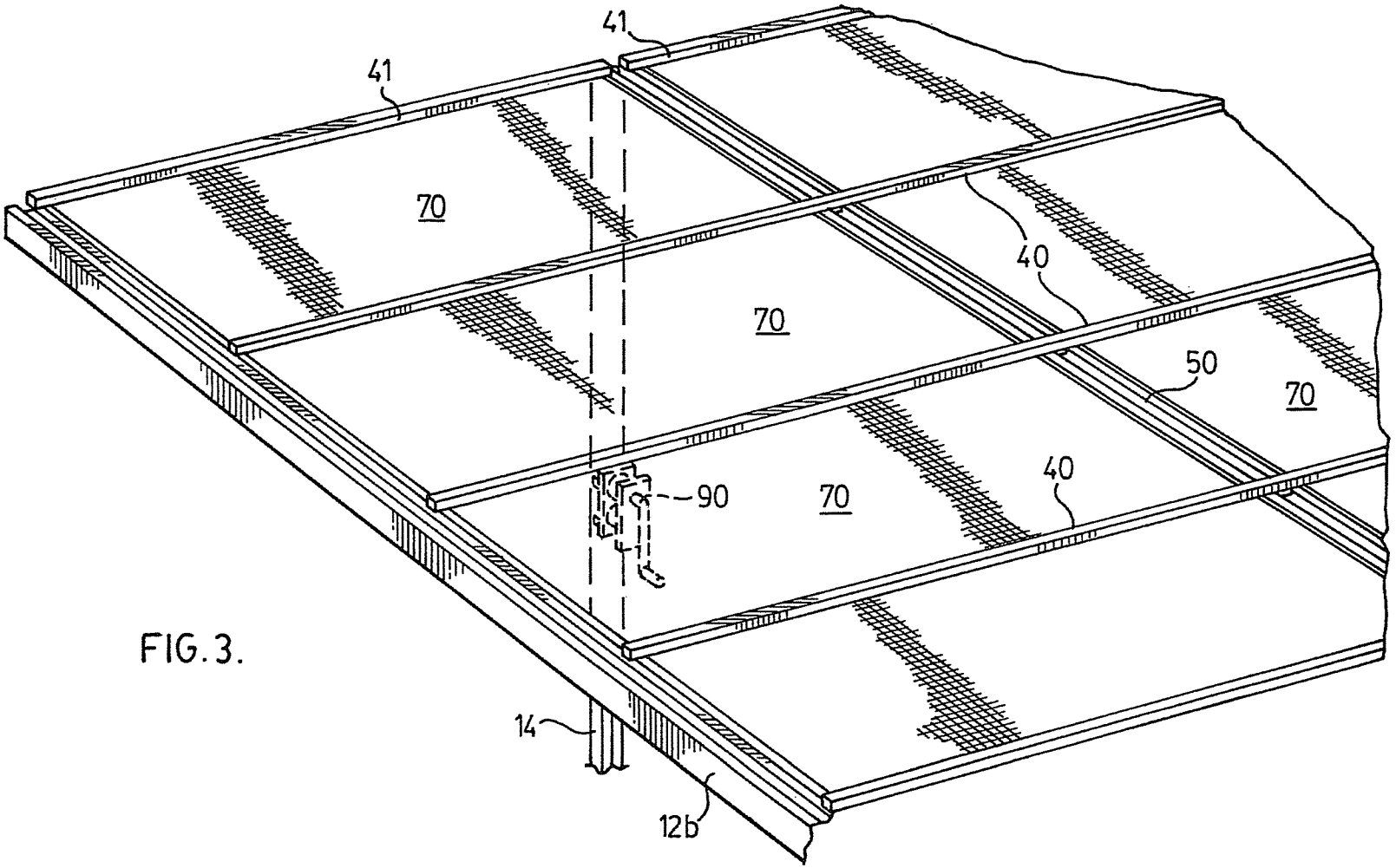
FIG. 3 is a partial perspective view of the sun shade of FIG. 1 in a fully extended position.

FIGS. 1 to 3 illustrate an embodiment of the invention having a fabric sections 70 retractably disposed on top of a frame 10. The frame 10 may for example comprise a plurality of joists 12 supported by posts 14 as necessary to support the weight of the sun shade and comply with building code requirements. The joists 12 comprise track-supporting joists 12*a* interspersed with boom-supporting joists 12*b*.

Figure 5:
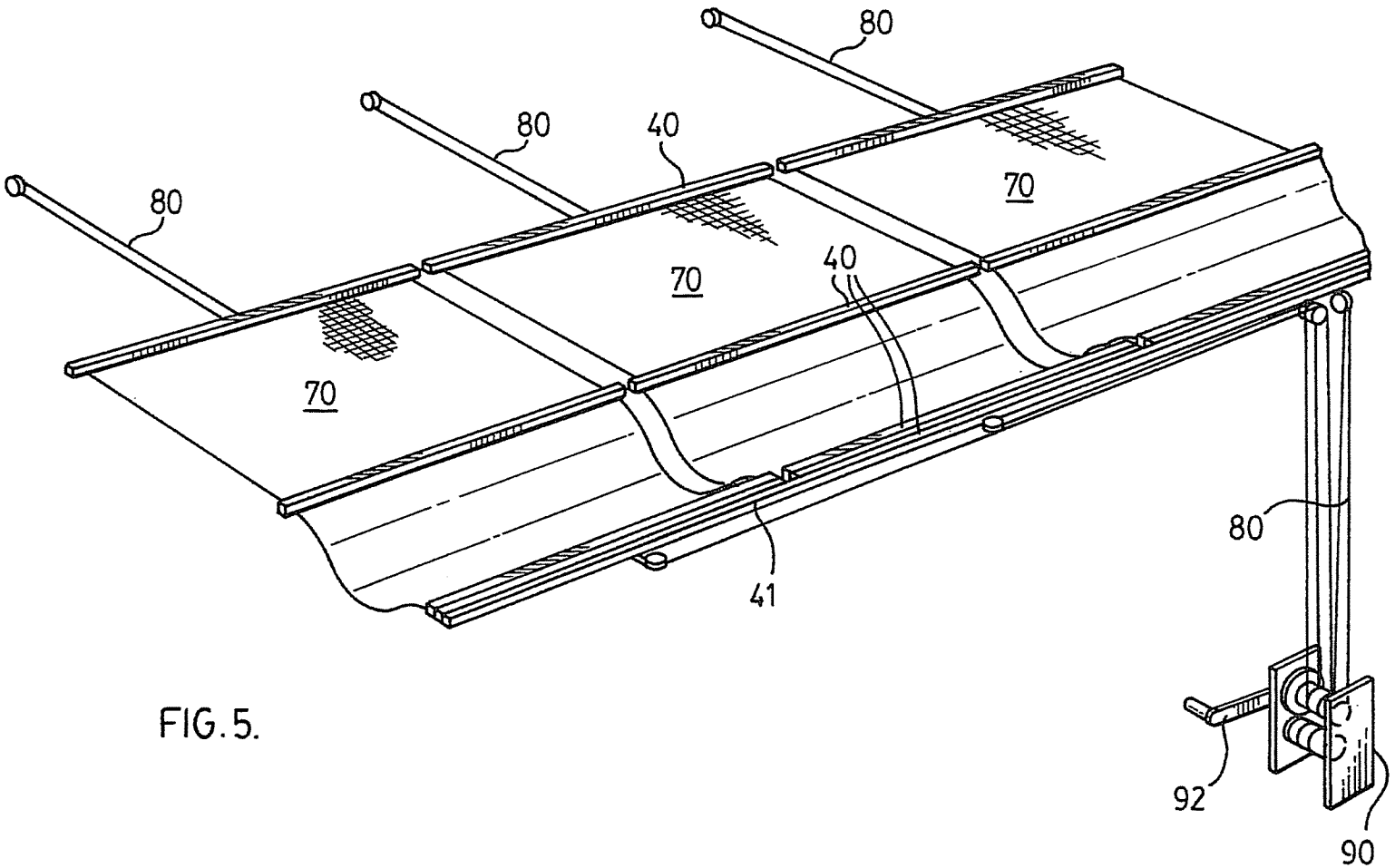
FIG. 5 is a perspective view of the sun shade of FIG. 1 with the frame removed for purposes of illustration, showing the cabling arrangement.
Figure 6:
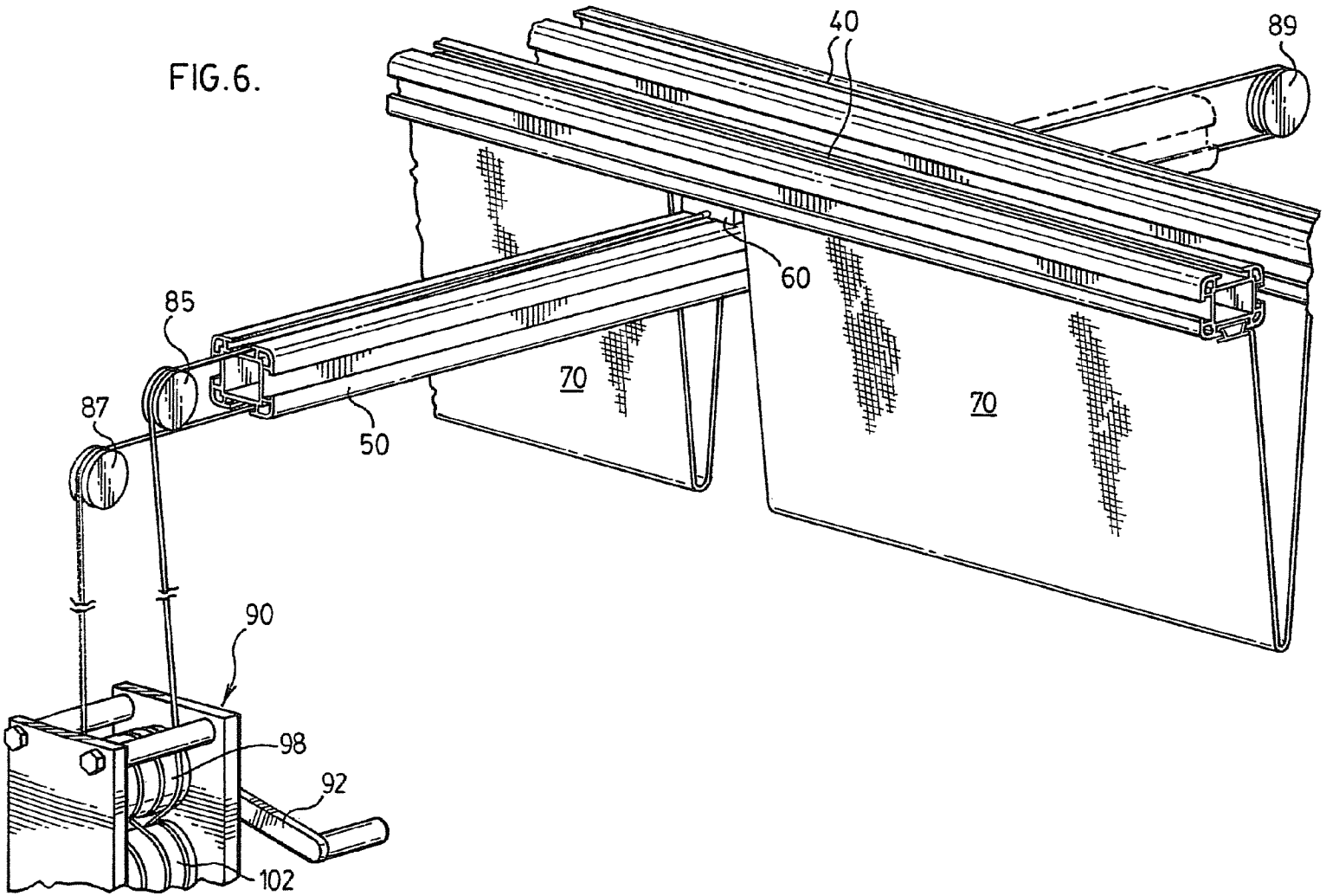
FIG. 6 is a partial perspective view of a track showing the path of the cable.
Figure 7:
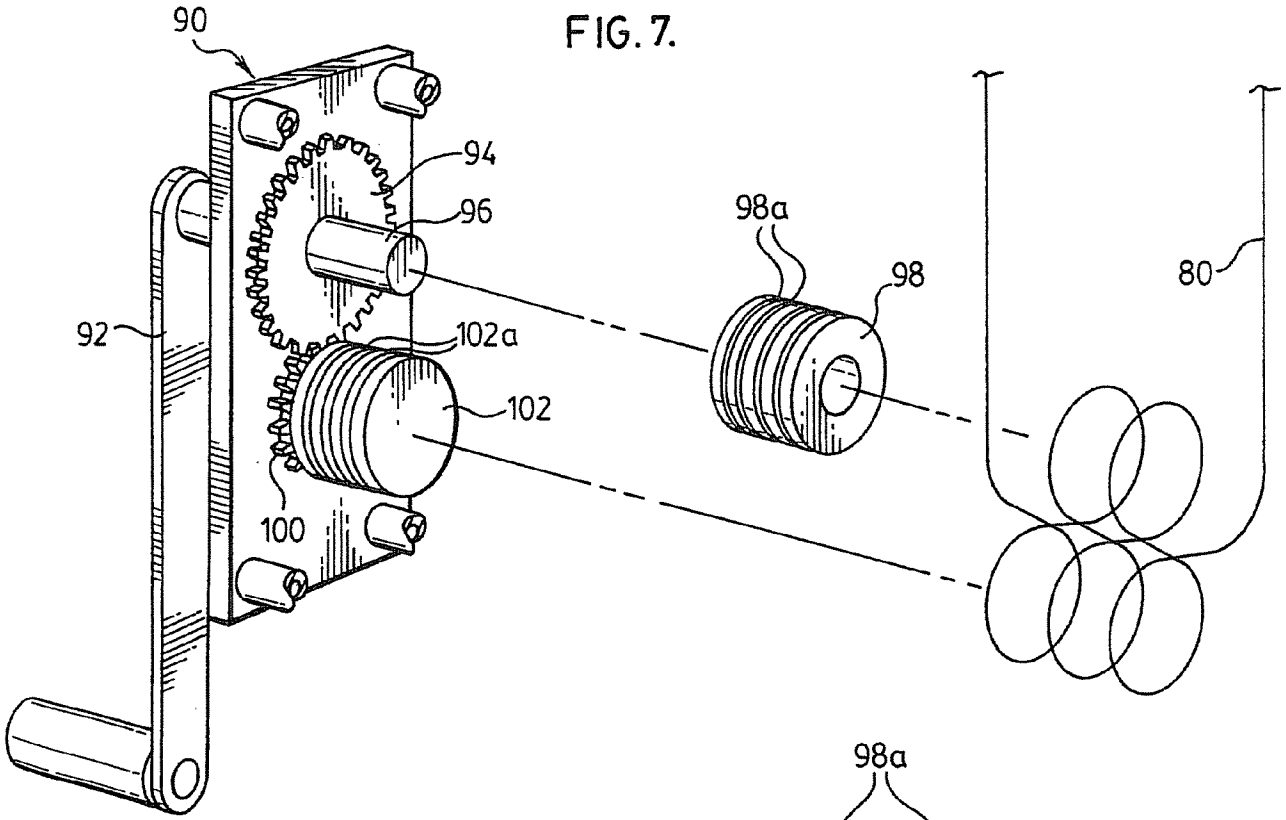
FIG. 7 is a schematic exploded view showing the preferred manner of winding the cable around the crank drums.
Figure 7A:
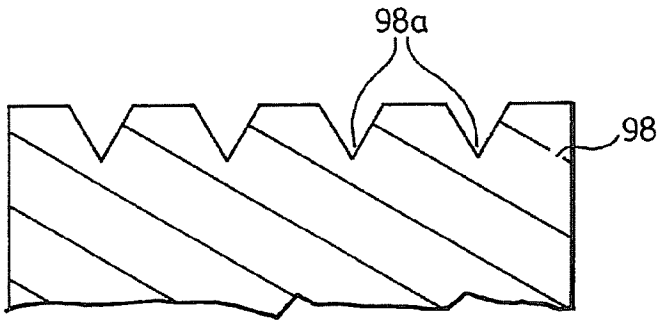
Figure 8:
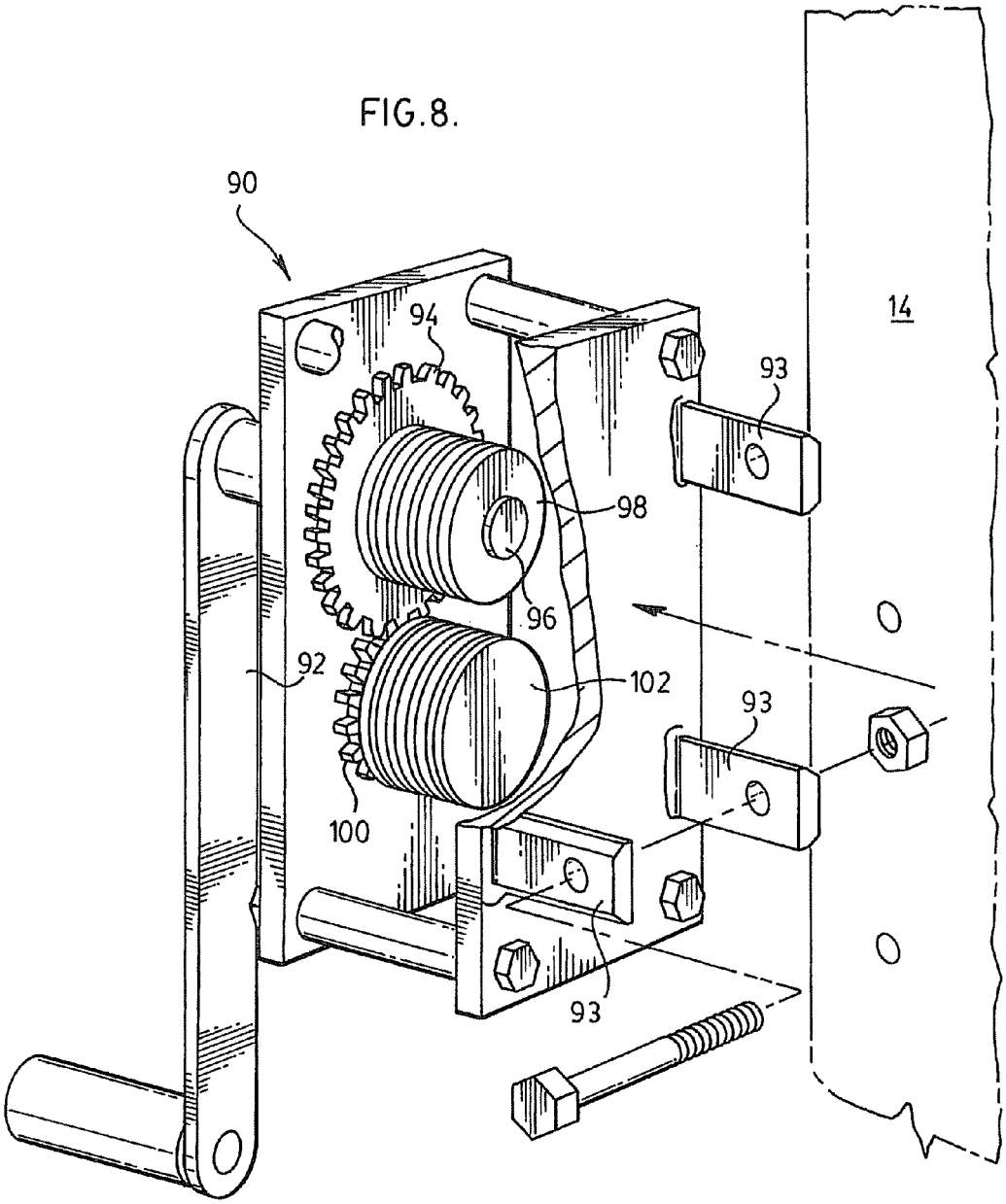
FIG. 8 is a partially cut away view of the crank.

The track-supporting joists 12*a* preferably provide a groove or rut 13 into which a track 50 nests. In the embodiment illustrated the track-supporting joists 12*a* are composed of lumber, for example a pair of 2×8 boards 16 of a suitable wood (such as spruce) separated by a spacer 18. The boom-supported joists 12*b* may optionally be identical to the track-supporting joists 12*a*, so that a single configuration of joists can be used for both the track-supporting joists 12*a* and the boom-supporting joists 12*b*, which reduces inventory requirements and simplifies construction and installation; however, as will be described below, the boom-supporting joists 12*b* merely support the ends of the booms 40 to limit the rocking motion of the booms 40 under the influence of the environment and therefore merely need to be wide enough to avoid the ends of the booms 40 from slipping off the joists 12*b* and from interfering with laterally adjacent booms 40 if multiple sun shade sections are provided, for example as shown in FIG. 5.

In a preferred embodiment the boom-supporting joists 12*b* only provides support to the ends of the booms 40 if they tip or flex during actuation of the boom 40 or under the effect of wind or other elements. In an alternate preferred embodiment, described below, the ends of the booms 40 are unrestrained and may tip or flex in response to their environment. The frame 10 may be supported at one end by a structure such as the wall of a house or commercial premises (not shown), or may be supported on posts 14 along both ends and, if required to support the weight, as required at intermediate points along each joist 12*a* or 12*b*. The frame 10 may be as wide as desired, and can extend any practical distance from the structure, for example up to 40 feet or even longer, using standard lumber.

Figure 12:
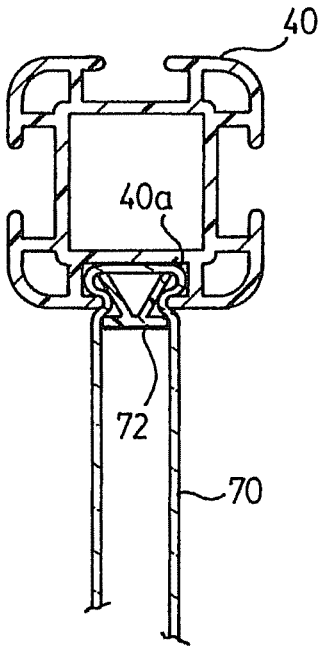
FIG. 12 is a cross sectional elevation of the boom of FIG. 11.
Figures 13, 14:
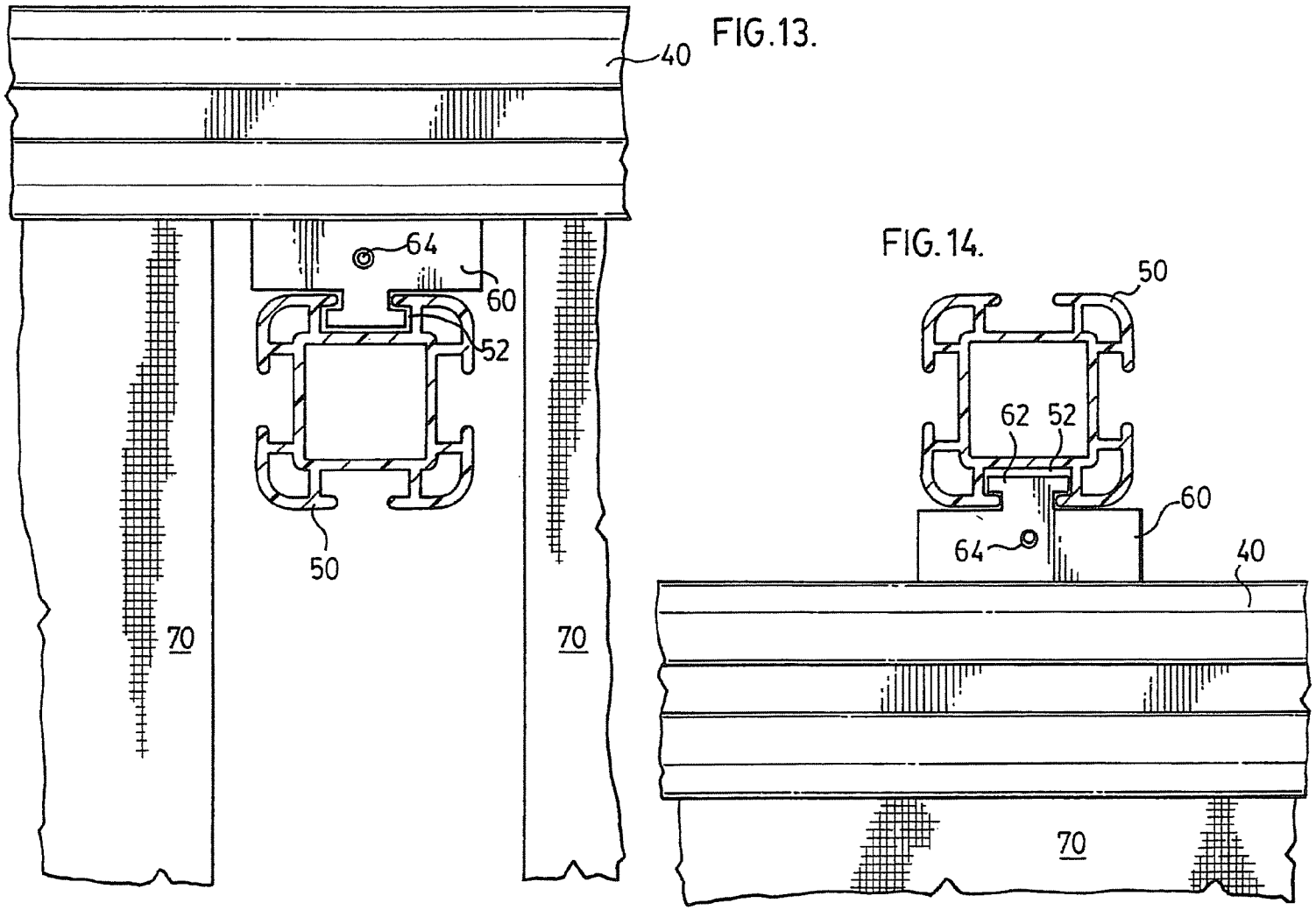
FIG. 13 is a cross sectional elevation showing the runner engaged in the track.
FIG. 14 is a cross sectional end elevation of a further embodiment of the sun shade of the invention in which the fabric is disposed beneath the frame.

In an embodiment, the booms 40 are provided along one face with a groove 40*a* into which a section of fabric 70 may be secured by a spline 72 (as best seen in FIG. 12). In the embodiment illustrated the booms 40 are formed from a plastic extrusion which has grooves 40*a* on each face for convenience. This also allows the same extrusion to be used for the track 50 described below, and may be advantageous when used with an under-frame embodiment illustrated in FIG. 14. However, it is sufficient to provide a single groove 40*a* along a single face of the boom 40. Depending upon the size of the boom 40, it may be desirable to insert a reinforcing member such as a steel rod or tube (not shown) into the plastic extrusion for additional strength and/or rigidity.

The spline 72 may be a conventional rubber or foam spline, which is compressed sufficiently to hold the weight of the fabric sections 70. The fabric sections 70 may be formed separately or from a single sheet, and composed of any fabric suitable for the intended use (i.e. wholly or partially impervious to sunlight). The fabric may be waterproof if desired.

Figure 10:
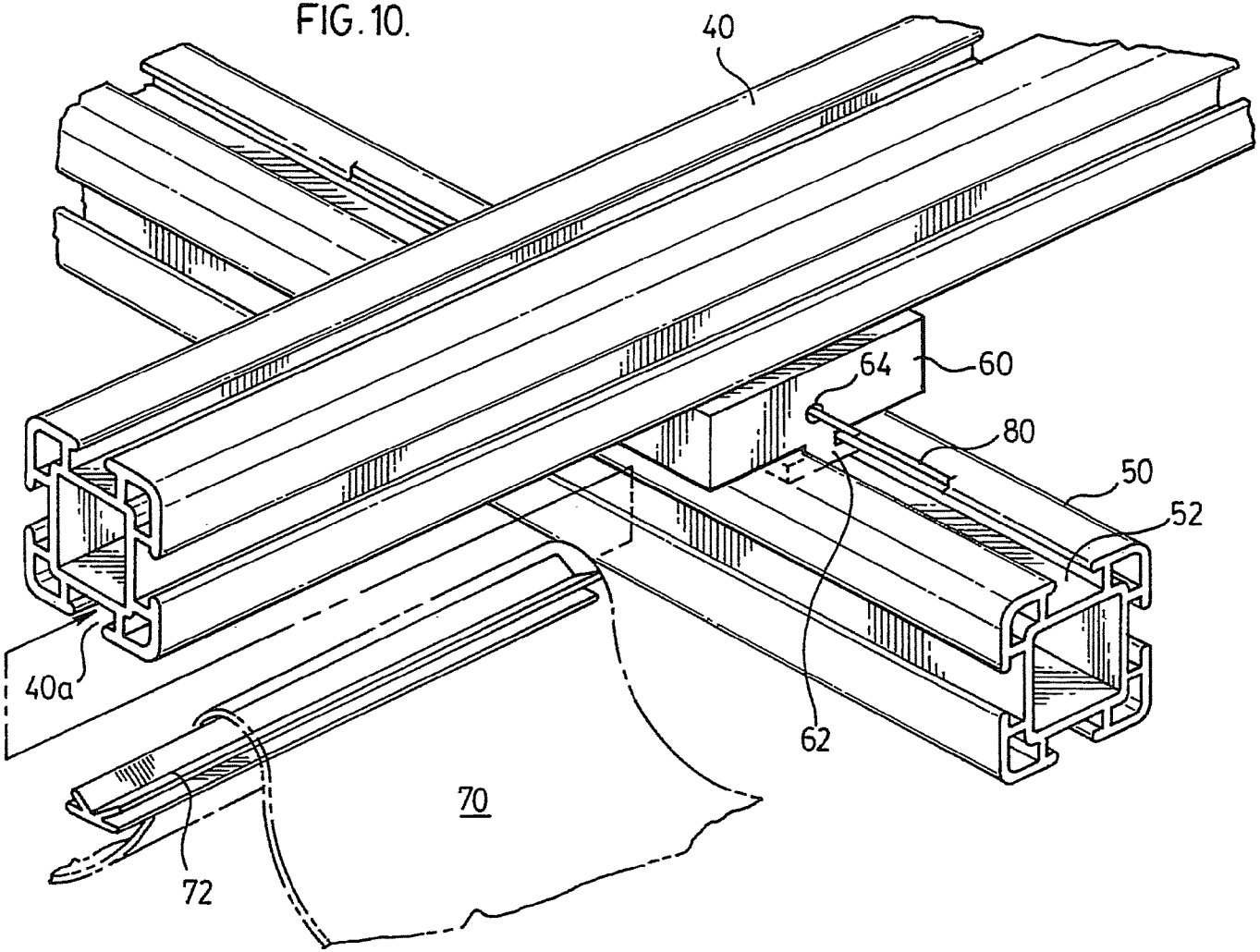
FIG. 10 is a partial perspective view of a runner engaged in a track in the sun shade of FIG. 1.

In the embodiment of FIGS. 1 to 3 the booms 40 are each provided with two fabric sections, one on either side of the track supporting joist 12*a*. The ends of the booms 40 are supported above the boom-supporting joists 12*b*. The boom 40 is slideably affixed to the track 50, for example by a runner 60, shown in FIG. 10, affixed to the boom 40 and slideably engaged to the track 50. The runner 60 may for example comprise a block of plastic engaged to the boom 40 at an intermediate point of the boom. In a preferred embodiment illustrated, the runner 60 is engaged to the boom 40 generally centrally, for example into the groove 40*a*, as by bonding or suitable fasteners. The runner 60 may alternatively comprise an attachment point for the boom 40 and be slideably engaged to track 50 through the use of rollers, ball bearings, or other rotating element. In the embodiment shown the runner 60 comprises a "T"-shaped rib 62 engaged into a complementary channel 52 in the track 50. Like the boom 40, in the embodiment shown the track 50 is composed of a plastic extrusion which has grooves along all four faces, however this is solely a convenience and a single "T"-shaped channel 52 will suffice.

The runner 60 may either be rigidly connected to the boom 40, or alternatively may provide for limited movement of the boom 40 provided it constrains the boom in a direction of drawing along the track 50. Allowing for limited movement of the boom 40 may be desirable in embodiments where the ends of the boom 40 are unconstrained and it is desired to allow for some movement or flexing of the shade in response to the environment.

Thus, while the runner 60 is fixed to the boom 40, it is slideably engaged to the track 50 for purposes of drawing the boom 40 along the track 50, extending and retracting the fabric sections 70, as will be described below. The booms 40 are thus able to slide along the track 50, and their orientation is maintained by the engagement of runner 60 in groove 52 of track 50. The runner 60 is provided with a hole 64 oriented in the direction of the track 50, for accepting a flexible drawing element such as a cable 80 which draws the boom 40 and extends and retracts the fabric sections 70 in the manner described below.

A crank 90 is provided to actuate the cable 80. Alternative cranks or drive mechanisms may be used, either manual or power operated (for example via an electric motor).

A preferred embodiment of the crank 90 is illustrated in FIGS. 5 to 9. The crank 90 comprises a handle 92 rotationally fixed to a drive gear 94. Projecting from the drive gear 94 is a spindle 96 over which is mounted a free-rolling control drum 98. The drive gear 94 drives an actuating gear 100 which is rotationally fixed to an actuating drum 102. Each of the drums 98, 102 is provided with slots, for example V-shaped slots 98*a* and 102*a*, respectively, for receiving and frictionally engaging the cable 80 which may be wound generally in the manner illustrated in FIG. 7. As illustrated in FIG. 1, the crank 90 may be conveniently mounted on post 14 supporting the track supporting joist 12*a*, which reduces the amount of cable 80 required to move the booms 40.

Any number of sun shade sections such as that illustrated in FIGS. 1 to 3 may be arranged side by side. Each such section may have its own crank 90 (or other actuating mechanism), or the side by side sections may be actuated by the same mechanism if desired, for example as shown in FIG. 5.

Figure 9:
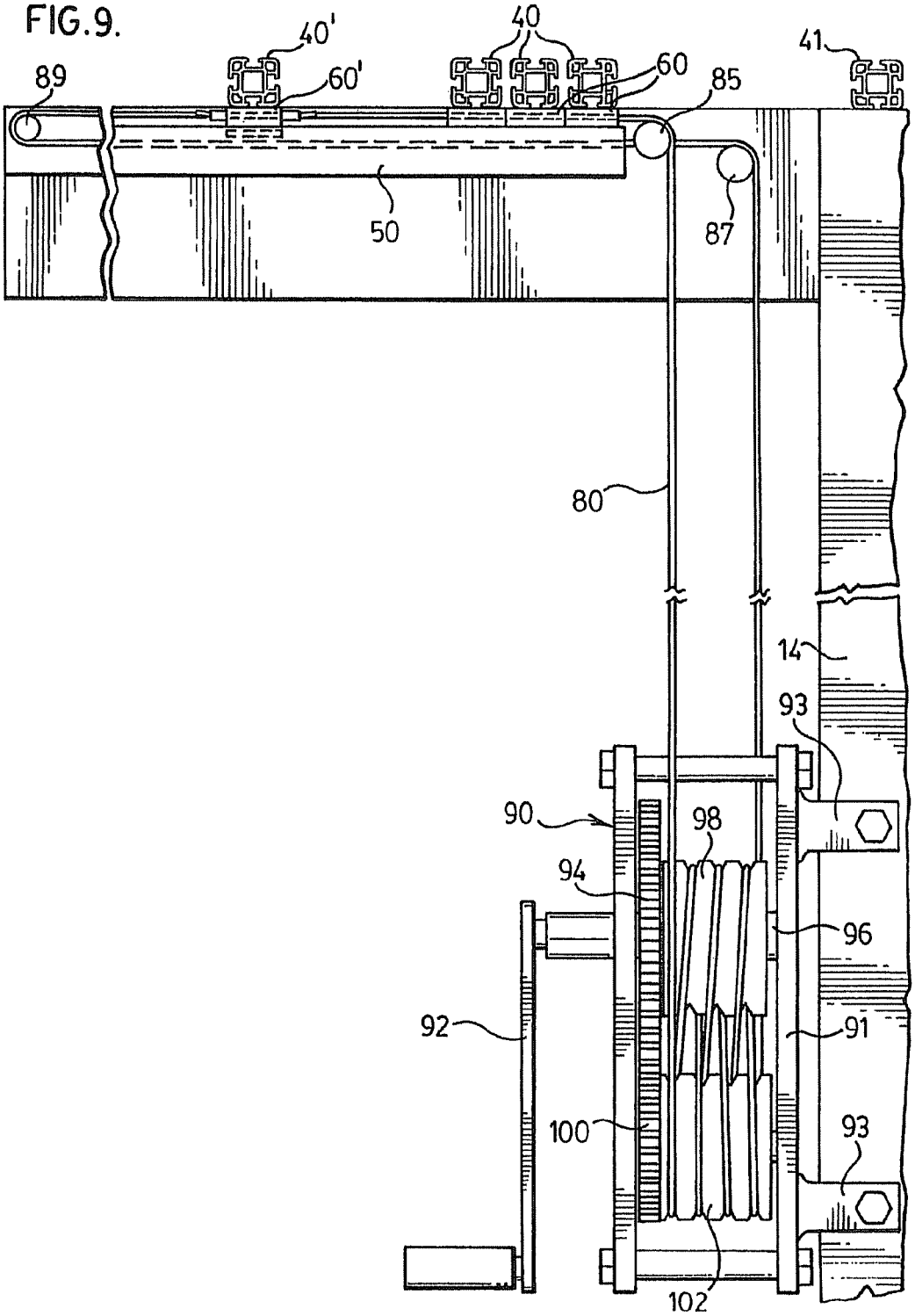
FIG. 9 is a side elevation of the crank.

The cable 80 forms a closed-loop, allowing the crank 90 to both extend and retract the fabric sections 70 in the manner described below. As illustrated in FIG. 9, the cable 80 extends through all of the runners 60 except for the leading runner 60' (see FIG. 4). Both ends of the cable 80 are fixed to the lead runner 60. From the trailing end of the leading runner 60' the cable extends so as to slide freely through the remaining runners 60, over a first rear pulley 85 and down to the crank 90. The cable 80 extends around the free-rolling control drum 98 and actuating drum 102, for example in the manner illustrated in FIG. 7, in order to allow the cable 80 to be paid out in both directions without winding over itself and thus inhibit payout in the opposite direction, and to provide reliable and consistent frictional resistance in both directions. The cable may in this embodiment be a 1/16" steel cable, and in the arrangement illustrated will not slip substantially during retraction or extension of the sun shade.

The drums 98, 102 are preferably contained within a housing or frame 91, which is attached to the post 14 as by brackets 93. As shown in FIG. 9, the cable extends back up to the frame 12 and over a second rear pulley 87. The cable extends through the rut 13 beneath the ribs 62 of the runners 60 and spaced therefrom so that the cable 80 can move freely, extends around front pulley 89, and is then tied to the leading end of the leading runner 60'.

Figure 4:
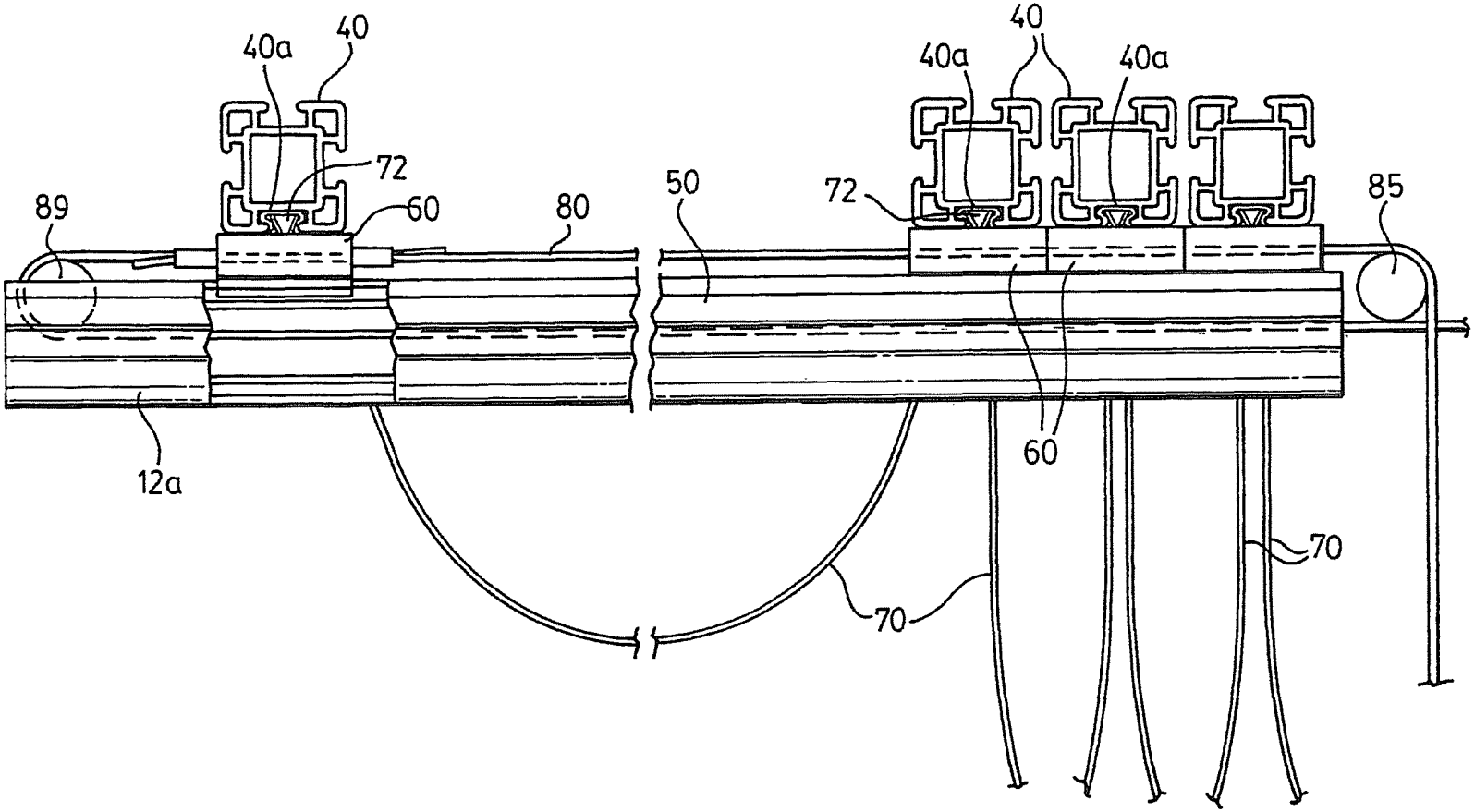
FIG. 4 is an end view of the sun shade shown in the partially extended position of FIG. 2.

In operation, the retracted sun shade is in the position illustrated in FIG. 1. A user rotates the handle 92 of the crank 90, which rotates drive gear 94 and in turn actuating gear 100. Actuating gear 100 rotates actuating drum 102 which, co-acting with the free-rolling control drum 98, frictionally engages the cable 80 sufficiently to move the cable 80. The cable 80 draws the leading runner 60' along the track 50, moving boom 40 toward the opposite side of the frame 10 (in the embodiment shown, furthest from the structure). As the lead boom 40' moves, the fabric section 70 between the lead boom 40' and the immediately succeeding boom 40 starts to come under tension, as illustrated in FIG. 4. When the fabric section 70 between the two booms 40 is taut it begins to draw the next succeeding runner 60 and boom 40 towards the extended position, which starts to tension the next succeeding fabric section 70, etc. until all fabric sections 70 have been drawn taut and the sun shade extends fully across the frame 10 from the front end (at the left in FIG. 9) to the rear.

As the booms 40 move into the extended position, the ends of each boom 40 are supported on the boom supporting joists 12*b*, and the weight and tension of the fabric sections 70 keep the booms 40 substantially perpendicular to the track 50.

To retract the sun shade, the user rotates the handle 92 in the reverse direction, so that the other end of the cable 80 (which runs freely through all runners 60 except for the lead runners 60') starts to draw the lead runner 60' and the boom 40 supported thereon back to the retracted position (at the right in FIG. 9). The fabric section 70 droops as the lead boom 40' moves, until the lead boom 40' eventually contacts the next succeeding boom 40 and starts to push it toward the retracted position, and each additional boom 40 in turn, until the sun shade returns to the fully retracted position shown in FIG. 1.

A sun shade according to the invention can be self-closing in high winds, i.e. a gust of wind that might be strong enough to tear or damage the sun shade will instead overcome the frictional engagement of the drums 98, 102 against the cable 80 as the fabric sections 70 billow, allowing the booms 40 to collapse upon each other toward the retracted position and avoiding possible damage. The alignment of the booms 40 during extension and retraction is essentially self correcting, because the weight and tension of the fabric sections maintain the booms 40 approximately parallel and generally perpendicular to the track 50.

Figure 11:
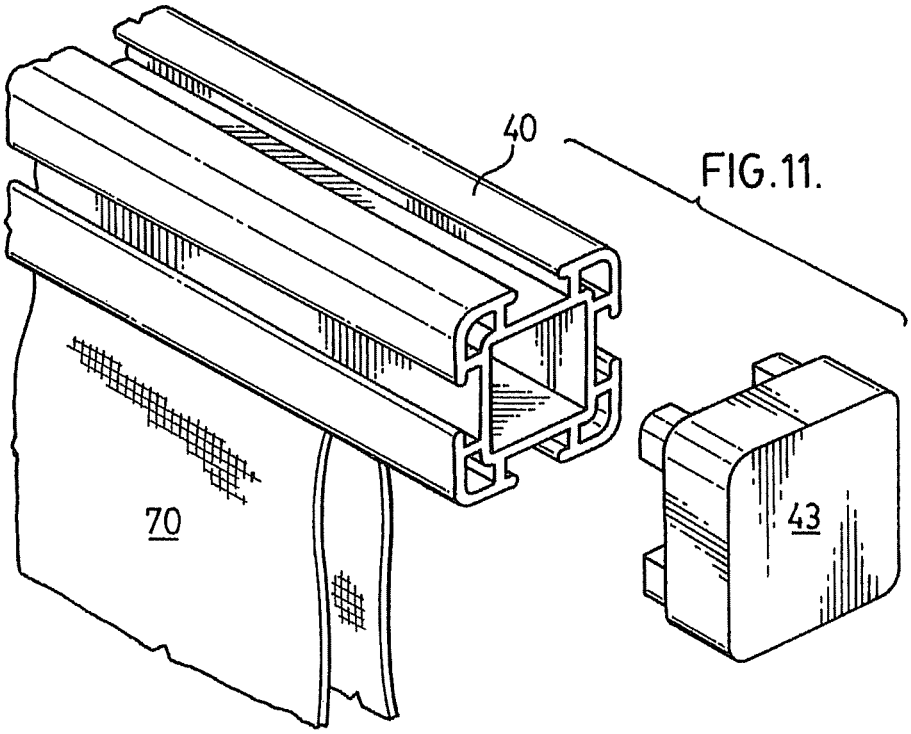
FIG. 11 is a partial perspective view of a boom in the sun shade of FIG. 1.

The fabric sections 70 may be attached to the end of the frame 10, either directly or to a stationary boom 41 attached to the end of the frame 10, as illustrated in FIG. 3. The boom 40 may be provided with an end cap 43, illustrated in FIG. 11, for aesthetic and/or weatherproofing purposes.

Figure 15:
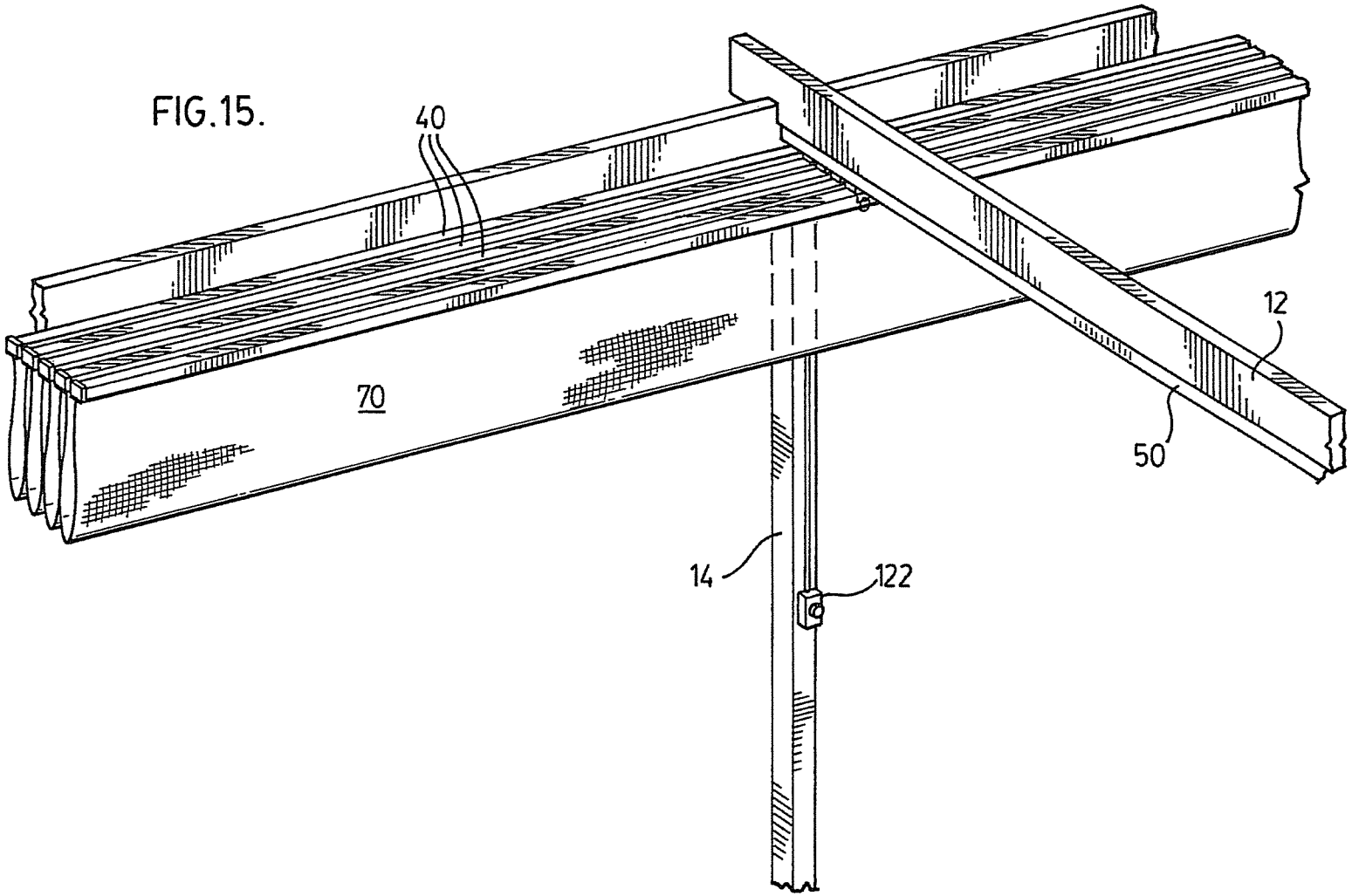
FIG. 15 is a partial perspective view of the retractable sun shade of FIG. 14 in a fully retracted position.
Figure 16:
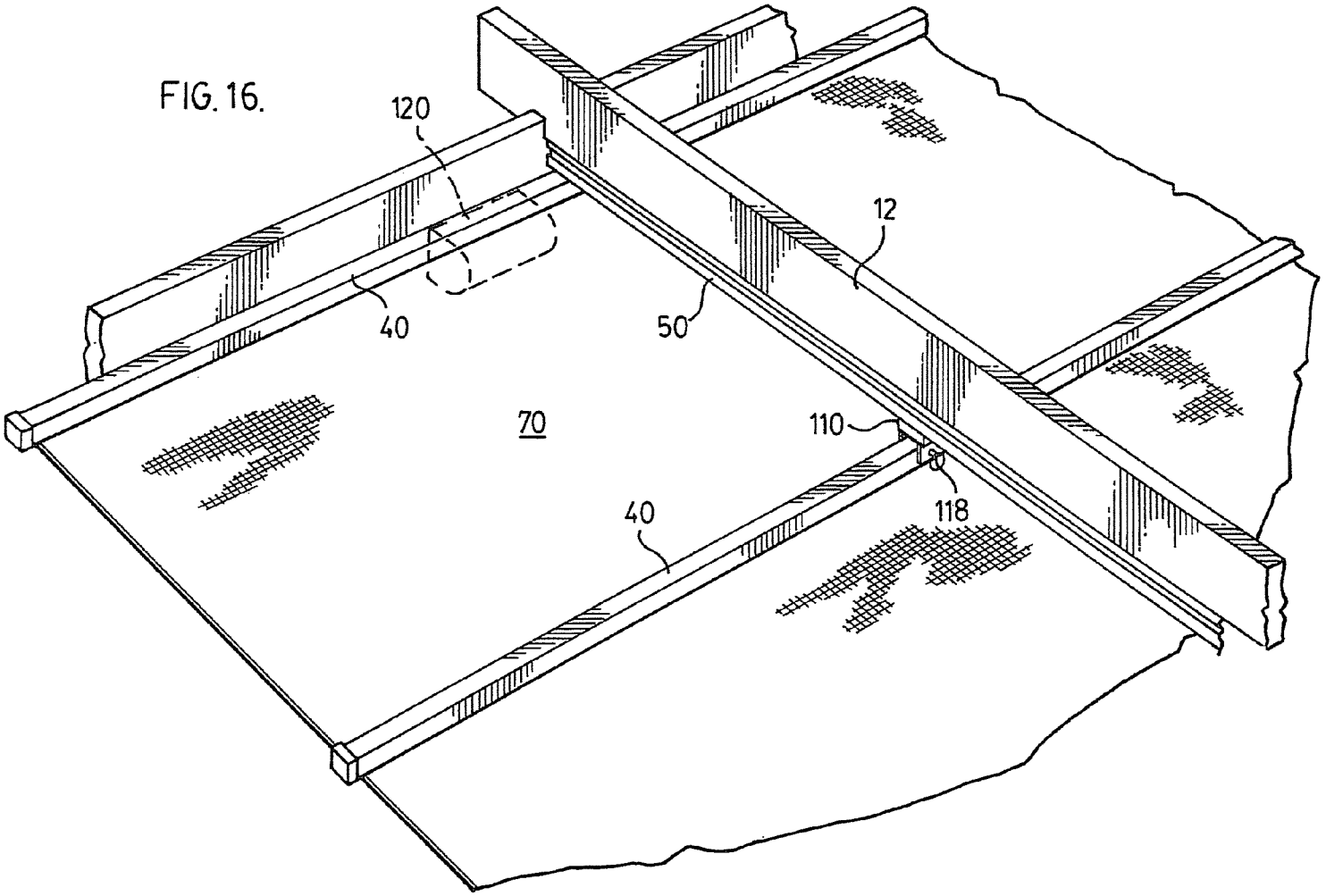
FIG. 16 is a partial perspective view of the sun shade of FIG. 14 in an extended position.
Figure 17:
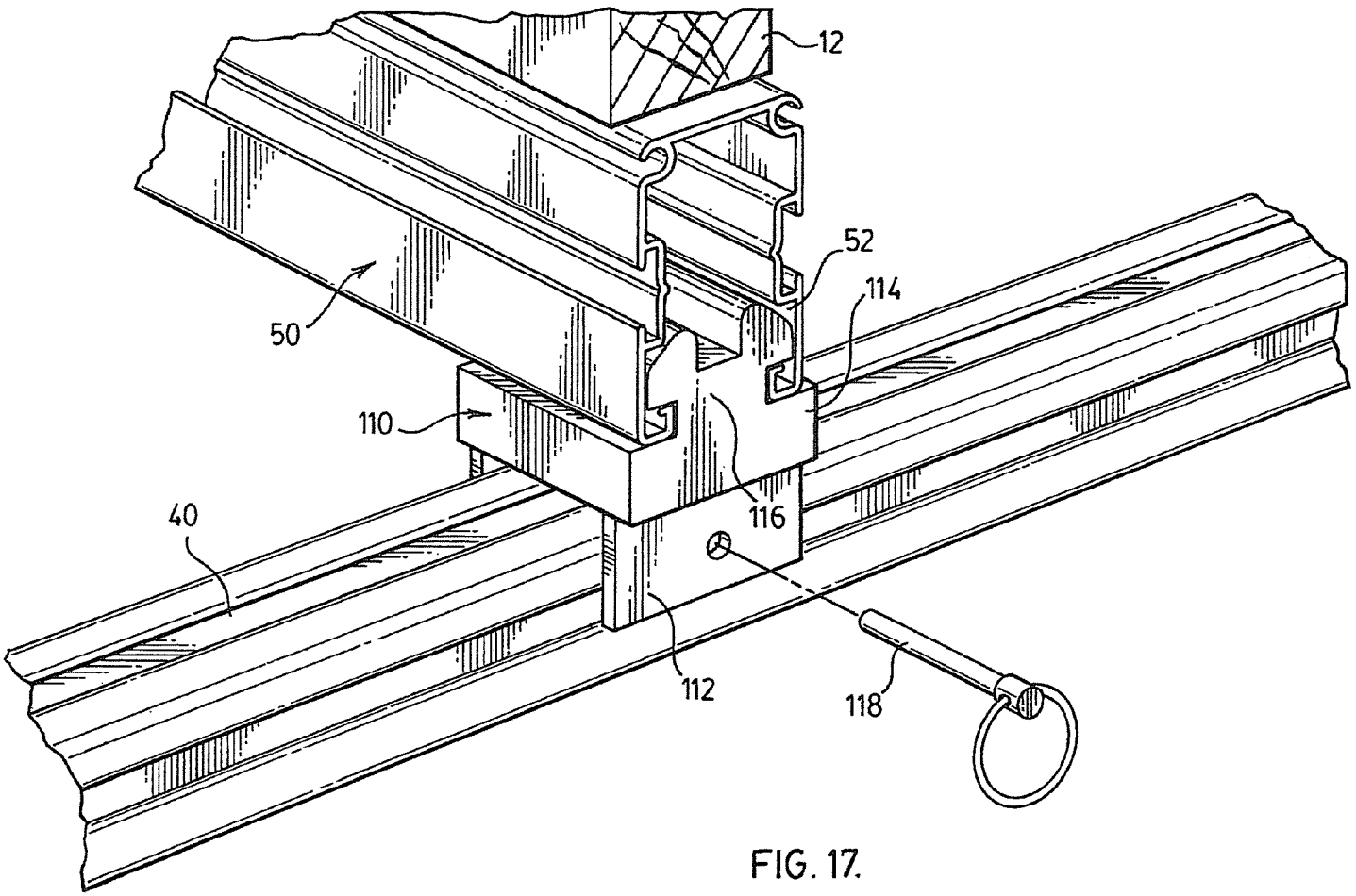
FIG. 17 is a partial perspective view of a suspending mechanism for the boom in the sun shade of FIG. 14.

FIGS. 14 to 19 illustrate a further embodiment of the invention in which the runner 60 is disposed beneath the track 50. In this embodiment, as best seen in FIG. 15, the fabric section 70 may extend fully across the entire lateral length of the frame 10 without requiring spaces between fabric sections 70 to accommodate the track supporting joists 12*a* (unlike in the embodiment of FIGS. 1 to 3). In the embodiment of FIGS. 14 to 19 the use of a waterproof or water-resistant material may be desirable, as the water will be diverted off of the ends of the sun shade. The embodiment shown is extended and retracted by a motor 120 activated by a button 122, for convenience, however as in the previous embodiment any other suitable means of extension and retraction may be provided.

Figure 18:
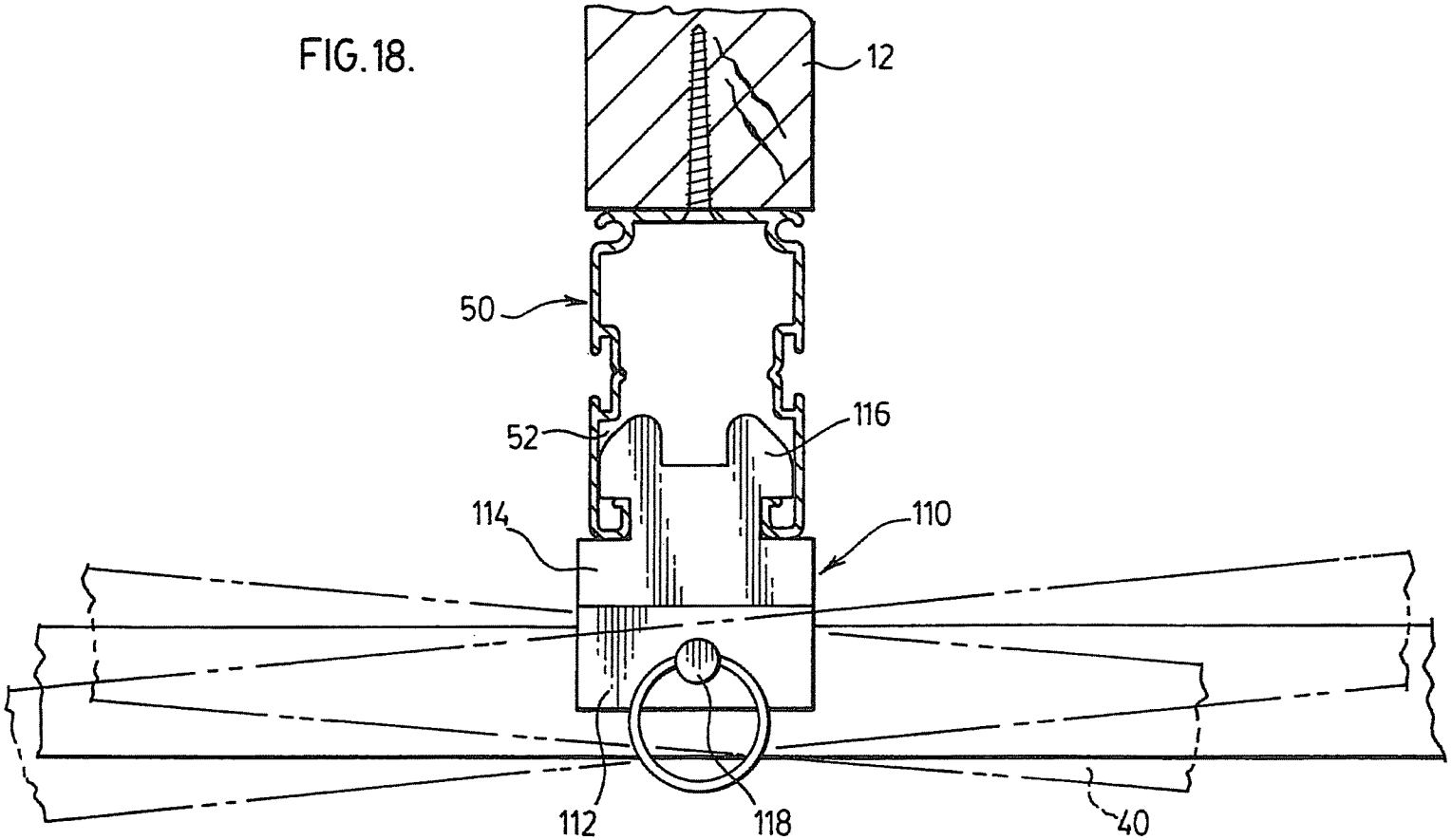
FIG. 18 is a cross-sectional elevation of the track showing the freedom of motion of the boom suspended as shown in FIG. 17.
Figure 19:
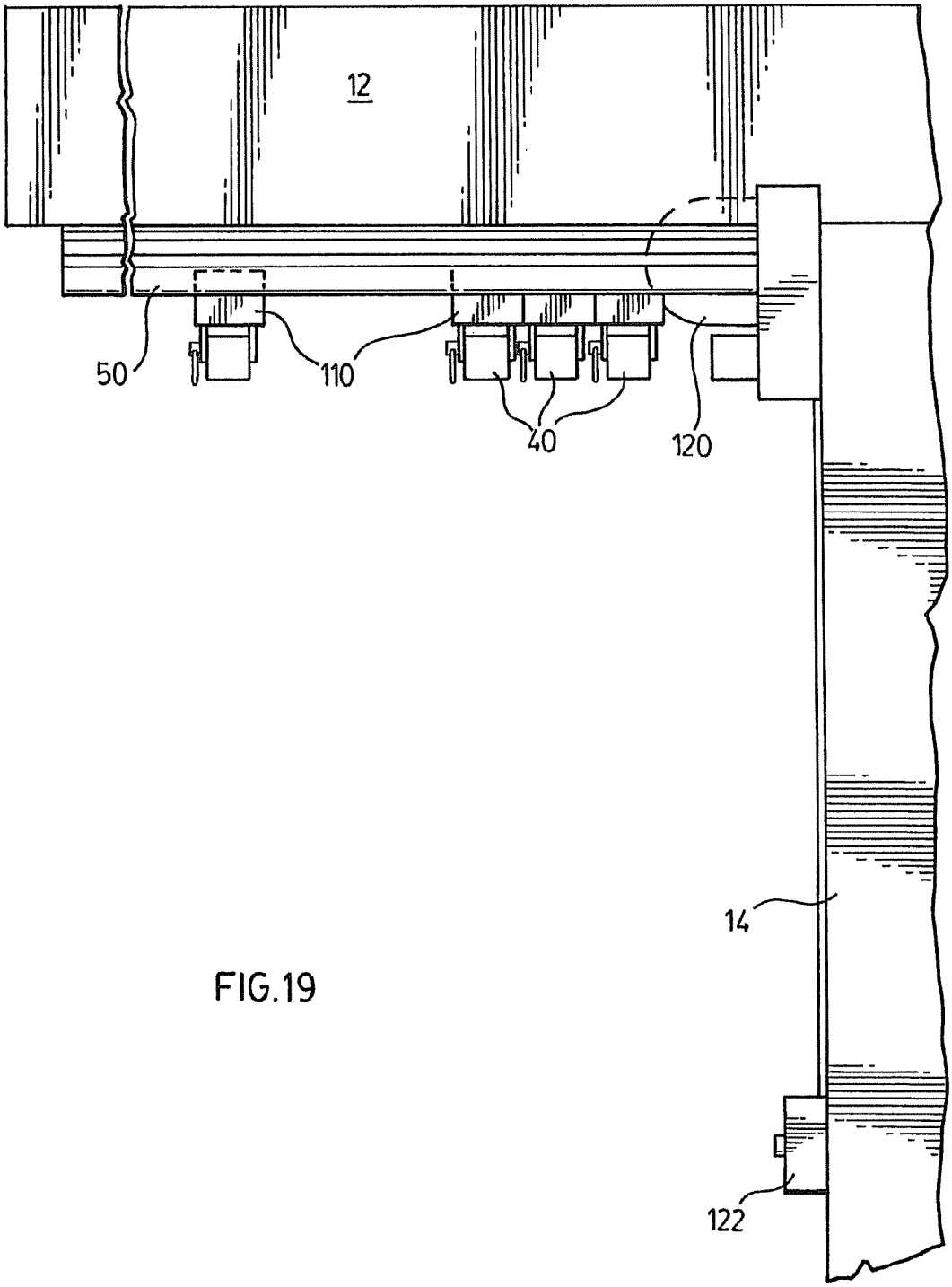
FIG. 19 is a side elevation of the sun shade of FIG. 14 in a partially extended position.

In this embodiment the track 50 may be affixed to the underside of a single joist 12, for example by screws or other suitable fasteners, and the ends of the boom 40 are unsupported. A runner 110 is slideably engaged to the track 50 for purposes of extending and retracting the fabric sections 70, as in the previous embodiment, via "T"-shaped rib 116 engaged into a complementary channel 52 in the track 50. It is advantageous in this embodiment to provide the runner 110 with brackets 112 depending from the runner block 114 between which the boom 40 is suspended with the ability to pivot somewhat, as shown in FIG. 18. The boom 40 is thus affixed to the brackets 112 by a pin 118, for example.

If desired, the fabric 70 can be allowed to drape or billow by tying a cord or "slave cable" (not shown) that is slightly shorter than the fully extended fabric section, between the lead boom 40 and the fixed boom 40 at the other end of the fabric section 70. In this fashion the fabric section 70 is prevented from fully extending, and the intermediate booms 40 will settle into a generally equally spaced arrangement with a generally uniform drape between booms 40. If desired the intermediate booms 40 can be affixed to the slave cable at the desired positions, to ensure the desired amount of draping between each adjacent pair of booms 40. Use of a slave cable allows for operation where tension is not applied to the fabric section 70 to actuate the shade.

Since in the embodiments illustrated the booms 40 are driven from their centres, and are not driven from or affixed at their ends, changes in the shape of the frame 10 and misalignment of drive means do not affect the ability of the booms 40 to slide freely along the tracks 50, thereby allowing for trouble-free extension and retraction.

Figure 20:
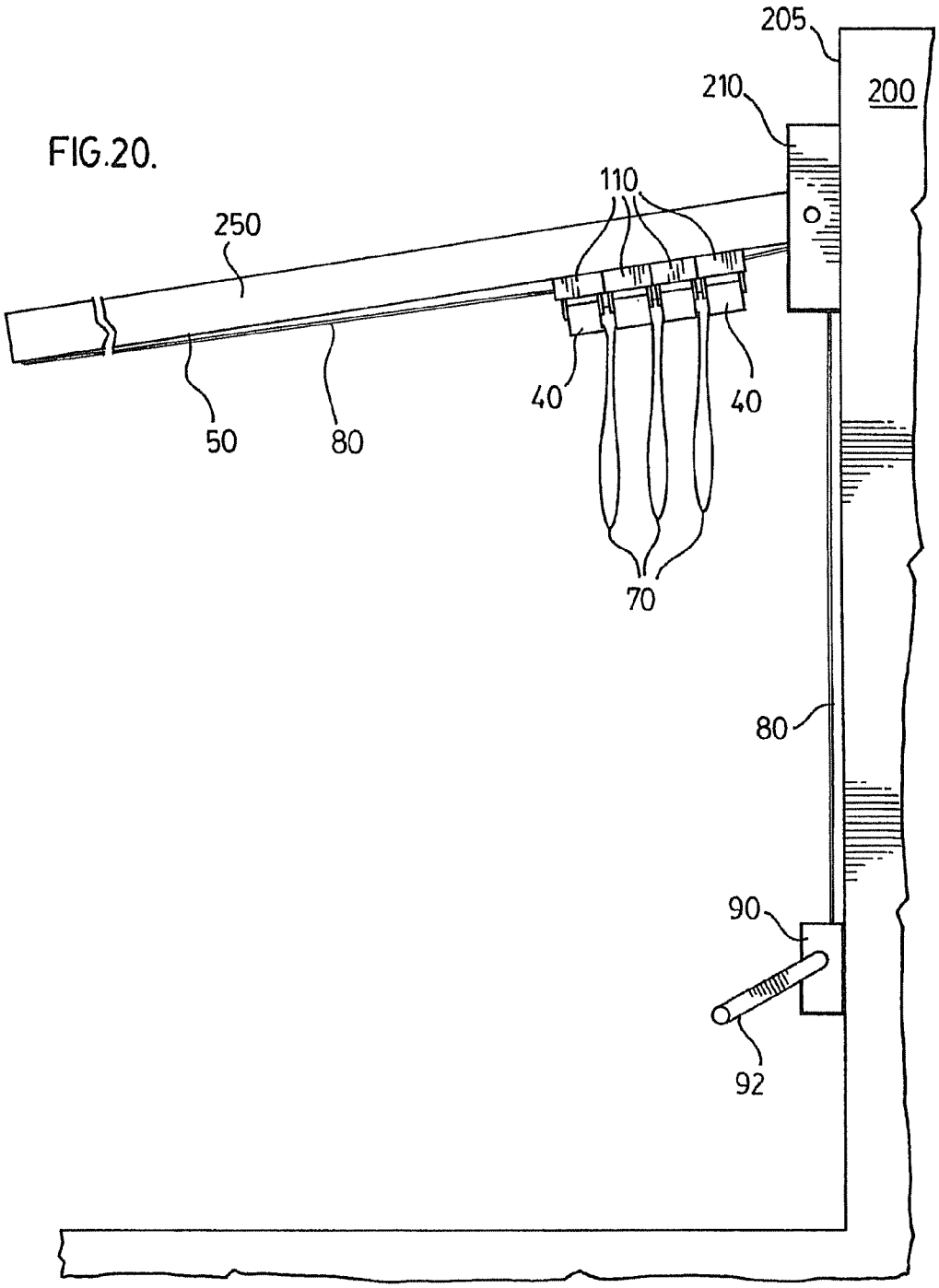
FIG. 20 is a side elevation of a sun shade supported by a bracket affixed to a structure.

In an embodiment illustrated in FIG. 20, track 50 may be affixed directly to a support structure, such as a wall 205 of a building 200, for instance where the frame 10 comprises a bracket 210. In the embodiment illustrated, the track 50 is integrally formed into a support beam 250, such as an aluminum or plastic beam. The beam 250 may be solely supported at bracket 210, or alternatively, one or more supports (not shown) may extend from an upper portion of the wall 205 to provide additional support along the length of the beam 250. In an embodiment support beam 250 may be pivotally mounted to bracket 210 to allow the beam 250 to be pivoted into substantial alignment with the wall 205 for storage.

In a preferred embodiment the runners 110 may be alternatively stowed at either end of the track 50, or at an intermediate portion of the track 50, and the booms 40 are pivotally mounted to the runners 110 to allow the booms 40 to rotate into near alignment with the beam 250. In such a fashion the booms 40 may be retracted and stowed at a portion of the track 50 remote from the retraction point and rotated into near alignment with the beam 250 to allow the beam 250 to be pivoted into substantial alignment with the wall 205 for stowage. Preferably the pivotal mount of booms 40 has at least a partial locking when the sunshade is extended to prevent excess movement in response to the environment.

Various embodiments of the present invention having been thus described in detail by way of example, it will be apparent to those skilled in the art that variations and modifications may be made without departing from the invention. The invention includes all such variations and modifications as fall within the scope of the appended claims.

What is claimed is:

1. A retractable sun shade, comprising:

a boom;

a track extending between a retraction point and an extension point;

the boom slideably affixed to the track at an intermediate portion of the boom, the track constraining the intermediate portion to a drawing direction along the track between the retraction point and the extension point;

at least one fabric section affixed to the boom, and extending between the boom and the retraction point, such that there is slack in the fabric when the boom is located proximate the retraction point; and at least one boom supporting joist situated near an end of the boom to limit an upward or a downward tipping or flexing motion of the boom at the end of the boom, but otherwise does not restrain the boom;

wherein the boom is configured to be drawn at the intermediate portion to cause the boom to slide relative to the track in the drawing direction from the retraction point towards the extension point, to extend the at least one fabric section; and, wherein the end of the boom is free to tip or flex about the intermediate portion of the boom in the drawing direction, but is limited by the at least one boom supporting joist from tipping or flexing in either the upward direction or the downward direction.

2. The retractable sun shade of claim 1, further comprising:

at least one other boom affixed to the at least one fabric section between the boom and the retraction point;

the at least one other boom slideably affixed to the track at an intermediate portion of the at least one other boom, the track constraining the intermediate portion of the at least one other boom to the drawing direction along the track between the retraction point and the boom;

wherein the at least one boom supporting joist is further situated near an end of the at least one other boom to limit an upward or a downward tipping or flexing motion of the end of the at least one other boom, but otherwise does not restrain the at least one other boom;

wherein the at least one fabric section is operative to draw the at least one other boom along the track when the at least one fabric section between the boom and the at least one other boom comes under tension as the boom slides down the track; and, wherein the end of the at least one other boom is free to tip or flex about the intermediate portion of the at least one other boom in the drawing direction, but is limited by the at least one boom supporting joist from tipping or flexing in either the upward direction or the downward direction.

3. The retractable sun shade of claim 1, wherein the intermediate portion of the boom is supported below the track.

4. The retractable sun shade of claim 1, wherein the intermediate portion of the boom is supported above the track.

5. The retractable sun shade of claim 1, wherein the boom is solely constrained against gravity by the slideable support at the intermediate portion.

6. The retractable sun shade of claim 1, wherein the at least one boom supporting joist is generally perpendicular to the boom and is sufficient to prevent the end of the boom from slipping off the at least one boom supporting joist.

7. The retractable sun shade of claim 1, further comprising a frame for supporting the track and the at least one boom supporting joist.

8. The retractable sun shade of claim 1, wherein the intermediate portion of the boom is supported below the track, and wherein the boom is solely constrained against gravity by the slideable support at the intermediate portion.

9. The retractable sun shade of claim 8, wherein the at least one boom supporting joist is positioned above the boom to limit an upward tipping or flexing motion of the boom.

10. The retractable sun shade of claim 1, wherein the at least one boom supporting joist is positioned below the end of the boom to limit the downward tipping or flexing motion of the end of the boom about the intermediate portion.

11. The retractable sun shade of claim 1, wherein the at least one boom supporting joist is positioned above the boom to limit the upward tipping or flexing motion of the end of the boom about the intermediate portion.

12. The retractable sun shade of claim 1, wherein the at least one boom supporting joist extends approximately parallel the track, and is offset from a height of the track to set a limit on the upward or downward tipping or flexing motion of the end of the boom.

13. The retractable sun shade of claim 1, wherein the at least one boom supporting joist comprises a pair of boom supporting joists situated on opposed sides of the track to limit the tipping or flexing motion of both ends of the boom in a same upward or downward direction.

14. A method of supporting and actuating a sun shade, the sun shade comprising at least one fabric section affixed to a boom and a retraction point such that there is slack in the fabric when the boom is located proximate the retraction point and the shade is extended when the boom is located proximate an extension point, the method comprising:

slideably affixing an intermediate portion of the boom to a track, the track constraining the intermediate portion of the boom to a drawing direction along the track between the retraction point and the extension point;

limiting a tipping or flexing motion ends of the boom in either an upward or a downward direction about the intermediate portion, but otherwise not restraining the ends of the boom; and, drawing the intermediate portion to slide the boom relative to the track from the retraction point to the extension point to draw the boom and extend the at least one fabric section, wherein the ends of the boom are free to tip or flex about the intermediate portion in the drawing direction between the refraction point and the extension point.

15. The method of claim 14, wherein at least one other boom is affixed to the at least one fabric section between the boom and the retraction point, such that there is slack in the at least one fabric section between the at least one other boom and the boom when the boom is located proximate the at least one other boom, the method further comprising:

slideably affixing an intermediate portion of the at least one other boom to the track between the boom and the retraction point, the track constraining the intermediate portion of the at least one other boom to a drawing direction along the track between the retraction point and the extension point; and limiting a tipping or flexing motion of ends the at least one other boom in either an upward or a downward direction about the intermediate portion of the at least one other boom, but otherwise not restraining the ends of the at least one other boom;

wherein when the at least one fabric section between the at least one other boom and the boom comes under tension as the boom slides away from the retraction point, the at least one other boom is configured to slide along the track towards the extension point when drawn by the tension in the at least one fabric section between the at least one other boom and the boom.

16. The method of claim 14, wherein the limiting the tipping or flexing motion of the boom further comprises limiting the tipping or flexing motion of the boom with boom supporting joists situated near the ends of the boom.

17. A retractable sunshade, comprising:

a boom;

a track extending between a retraction point and an extension point;

the track slideably supporting an intermediate portion of the boom affixed to the track, and constraining the intermediate portion to a drawing direction along the track between the retraction point and the extension point; and at least one boom supporting joist situated to limit an upward or a downward tipping or flexing motion of an end boom, but otherwise does not restrain the boom;

wherein the boom is configured to be drawn at the intermediate portion which slides the boom relative to the track in the drawing direction from the retraction point towards the extension point; and, wherein the ends of the boom are free to tip or flex in the drawing direction about the intermediate portion of the boom.

18. The retractable sunshade of claim 17, further comprising at least one fabric section affixed to the boom, and extending between the boom and the retraction point, such that there is slack in the fabric when the boom is located proximate the retraction point.

* * * * *